US005993359A

United States Patent [19]

Eschenbach

[11] Patent Number: 5,993,359

[45] Date of Patent: Nov. 30, 1999

[54] VARIABLE STROKE ELLIPTICAL EXERCISE APPARATUS

[76] Inventor: Paul William Eschenbach, 143 Lakeland Ave., Moore, S.C. 29369

[21] Appl. No.: 09/229,068

[22] Filed: Jan. 12, 1999

Related U.S. Application Data

[63] Continuation-in-part of application No. 08/955,173, Oct. 21, 1997.

[51] Int. Cl.[6] ..... A63B 69/16; A63B 22/04

[52] U.S. Cl. ..... 482/57; 482/51

[58] Field of Search ..... 482/51, 52, 57, 482/70, 71, 79, 80, 148

[56] References Cited

U.S. PATENT DOCUMENTS 5,529,555 6/1996 Rodgers ..... 482/57
5,637,058 6/1997 Rodgers ..... 482/51
5,762,588 6/1998 Chen ..... 482/70
5,779,599 7/1998 Chen ..... 482/57

*Primary Examiner*—Stephen R. Crow

[57] ABSTRACT

A standup cross trainer exercise apparatus simulates walking and jogging having separately supported pedals for the feet and arm exercise coordinated with the motion of the feet. Foot pedals move with a back and forth movement following an elongate curve path that has adjustable curve length during operation. The stride length of the foot pedals is adjustable to accommodate both long and short leg users. Foot pedals move with smooth elliptical motion resulting from a linkage mechanism having smooth orbital motion without the characteristic turnaround jerk associated with reciprocating member elliptical drives. Leg joint impact is controlled to be very low as to allow extended exercise without joint soreness. Arm exercise is coordinated with motion of the feet and adjusts with longer or shorter pedal strides to accommodate taller or shorter user.

27 Claims, 4 Drawing Sheets

VARIABLE STROKE ELLIPTICAL EXERCISE APPARATUS

This application is a Continuation-in-Part of previous application Ser. No. 08/955,173 filed Oct. 21, 1997.

BACKGROUND OF THE INVENTION

1. Field

The present invention relates to a standup exercise apparatus that simulates walking and jogging with arm exercise. More particularly, the present invention relates to an exercise machine having separately supported pedals for the feet and arm exercise coordinated with the motion of the feet. The pedal stroke can be changed during operation of the exercise apparatus.

2. State of the Art

The benefits of regular exercise to improve overall health, appearance and longevity are well documented in the literature. For exercise enthusiasts the search continues for safe apparatus that provides full body exercise for maximum benefit in minimum time.

Recently, a new category of exercise equipment has appeared on the commercial market called elliptical cross trainers. These cross trainers guide the feet along a generally elliptical shaped curve to simulate the motions of jogging and climbing. Generally they are large exercise machines using long cranks to generate a long foot stride. There is a need for a compact elliptical exercise machine capable of a similar long stride using a significantly shorter crank. Further, there is a need to adjust the length of the elliptical stride to accommodate users having different leg lengths.

Numerous combinations of levers and cranks to combine exercise for arms and feet can be found. Hex in U.S. Pat. No. 4,645,200 combines arm and foot levers for sit down exercise while Bull et al. in U.S. Pat. No. 4,940,233 combines arm and foot levers for standup exercise.

Lucas et al. in U.S. Pat. No. 4,880,225 offer oscillating arm levers coupled to the foot crank by a connecting rod. Dalebout et al. in U.S. Pat. Nos. 4,971,316 and 5,000,444 also shows oscillating swing arms coupled to the foot crank by an offset second crank and connecting rod. Lom in U.S. Pat. No. 4,986,533 offers oscillating arms driven by a crank-slider coupled to a foot crank.

Recently, there has been an effort to improve the up and down motion of stair climbers by the addition of horizontal movements. Habing in U.S. Pat. Nos. 5,299,993 and 5,499,956 offers an articulated linkage controlled through cables by motor to move pedals through an ovate path. Both pedal pivots follow basically the same guidance path curve directed by a motor controller. Stearns in U.S. Pat. No. 5,299,993 shows a stair stepping exercise machine which incorporates horizontal movement using a combination of vertical parallelogram linkage and horizontal parallelogram linkage to guide the foot pedals. The parallelogram linkages serve to maintain the pedal at a constant angle relative to the floor during a pedal cycle. The pedal pivots move through similar undefined guide paths.

Standup cycling is described in various patents such as U.S. Pat. No. 3,563,541 (Sanquist) which uses weighted free pedals as load resistance and side to side twisting motion. Also U.S. Pat. Nos. 4,519,603 and 4,477,072 by DeCloux describe standup cycling with free pedals in a lift mode to simulate body lifting.

Standup pedal exercise is shown in U.S. Pat. No. 4,643,419 (Hyde) and by the DP Air Strider as previously sold by Diversified Products of Opelika,AL where pedal platforms move by dual crank motion but remain parallel to the floor. Knudsen in U.S., Pat. No. 5,433,680 shows an elliptical path generating mechanism with pedals having only one pivot allowing the pedal to rotate unconstrained about the pivot as in a bicycle crank.

Standup pedal exercise combined with arm levers attached to the pedals is shown in Kummerlin et al. German Pat. No. 2,919,494 and in Geschwender U.S. Pat. No. 4,786,050. Standup pedal exercise coupled with oscillating swing arms is shown in Miller U.S. Pat. Nos. 5,242,343 and 5,383,829 and in Eschenbach U.S. Pat. No. 5,423,729. All of these exercise machines use pedals having two pedal pivots which are guided by a first circular guide path curve generated by a crank which rotates through one full revolution during a pedal cycle and a second arc guide path curve generated by a rocker link or track.

Recently, numerous elliptical exercise machines have appeared in the patent literature. Rogers,Jr. in U.S. Pat. Nos. 5,527,246, 5,529,555, 5,540,637, 5,549,526, 5,573,480, 5,591,107, 5,593,371, 5,593,372, 5,595,553, 5,611,757, 5,637,058, 5,653,662 and 5,743,834 shows elliptical pedal motion by virtue of various reciprocating members and geared linkage systems. Miller in U.S. Pat. Nos. 5,518,473, 5,562,574, 5,611,756, 5,518,473, 5,562,574, 5,577,985, 5,755,642 and 5,788,609 also shows elliptical pedal motion using reciprocating members and various linkage mechanisms along with oscillating guide links with control links to determine pedal angles. The Elliptical Cross Trainer by Life Fitness of Franklin Park IL also generates elliptical pedal motion using an elongated pedal supported by rollers on one end and an offset crank mechanism on the other end.

Chang in U.S. Pat. No. 5,803,872 and Yu et al. in U.S. Pat. No. 5,800,315 show a pedal supported by a rocker link and driven with a pair of links located under the pedal pivotally connected to a crank. Maresh et al. in U.S., Pat. No. 5,792,026 show a foot support member supported by a rocker link and driven by a double crank mechanism. Lee in U.S. Pat. No. 5,779,598 shows a pedal link driven by two separate cranks.

Lee in U.S. Pat. No. 5,746,683 shows a foot support member supported on one end with a compound rocker wherein a slider and handle lever support the rocker. Kuo in U.S. Pat. No. 5,836,854 offers a linear foot support member connected on one end to a crank and guided along an arcuate curve under the pedal by a linkage on the other end. Wang et al. U.S. Pat. No. 5,830,112 shows a foot support member sliding on a pivot on one end and attached to a crank on the other that can fold.

Chen U.S. Pat. Nos. 5,779,599 and 5,762,588 shows an elliptical pedal movement with a roller interface between the foot support member and crank but does not anticipate changing the pedal stroke length during operation. Chen in U.S. Pat. No 5,759,136 shows a foot support member with a moving pedal for adjustable elliptical motion wherein a link from the pedal to the crank can be repositioned while not in operation to change the pedal stroke length. Rodgers U.S. Pat. No. 5,743,834 shows a gear and screw mechanism to change the length of a rotary crank during operation which drives a linkage to generate elliptical pedal motion. A longer crank length will produce a longer pedal stroke but also causes an undesirable higher pedal lift. Eschenbach U.S. Pat. No. 5,788,610 shows a linkage mechanism to generate an elliptical pedal path wherein the orientation of the elliptical pedal curve can be changed during operation.

There is a need for a pedal operated exercise machine that can be safely operated in the standup position whereby the arms and legs can be exercised with the feet moving through a generally elliptical path wherein the operator can select different pedal stroke lengths and arm exercise during operation of the exercise apparatus without complicated gear mechanism.

It is one objective of this invention to provide a variable stroke elliptical pedal movement wherein the pedal stroke length can be changed during operation while the pedal lift remains generally the same. Another object of this invention is to provide arm exercise that changes to accommodate taller or shorter users.

SUMMARY OF THE INVENTION

The present invention relates to the kinematic motion control of pedals which simulate walking and jogging during operation. More particularly, apparatus is provided that offers variable intensity exercise through a leg operated cyclic motion in which the pedal supporting each foot is guided through successive positions during the motion cycle while a load resistance acts upon the mechanism.

The pedals are guided through an oblong or elongate curve motion while pedal angles are controlled to vary about the horizontal during the pedal cycle. Arm exercise is by arm levers coordinated with the mechanism guiding the foot pedals.

In the preferred embodiment, the apparatus includes a separate pedal for each foot, each pedal is supported by a foot support member which is pivotally attached on one end to a rocker link guide pivoted to the framework. The foot support member is supported on the other end by a set of rollers rotatably attached to cradle arms which are rotatably attached to a rotary crank. The crank completes one full revolution during a pedal cycle and is phased generally opposite the crank for the other foot support link through a bearing journal attached to the framework. The crank determines the lift of the pedal while the generally horizontal stroke length of the pedal is determined by a control linkage.

The control linkage is intended to take the crank motion as an input and to transform the rotary crank motion into variable reciprocating movement controlling the back and forth foot support member movement to produce a variable stroke pedal motion. The control linkage consists of: a control arm pivoted to the framework and to an actuator which is pivoted to the framework; a first control link is rotatably connected to the crank; a second control link is pivotally connected to the rocker link guide; a third control link is pivotally attached to the the first and second control links and to the control arm.

As the crank rotates, the first control link provides reciprocating movement to one end of the third control link. The second control link couples the third control link to the rocker link which guides one end of the foot support member to produce a predetermined pedal stroke length. When the actuator raises the control arm, the third control link is raised relative to the rocker link guide. The first and second control links also raise with the third control link. Because the third control link pivot on the control arm is above the rocker link pivot, the third control link movement is amplified as supplied to the rocker link by the second control link to produce a longer predetermined pedal stroke length. Conversely, when the control arm is lowered by the actuator, the third control link pivot drops below the rocker link framework pivot so that the third control link movement is decreased to produce a shorter pedal stroke. Pedal stroke can be varied from 10" to 24" in a commercial form of the preferred embodiment by programmed control or operator interface during operation of the exercise apparatus.

Arm exercise can be derived either from the third control link or the rocker link. In the preferred embodiment, a pair of handles for arm exercise are attached to the third control links. The back and forth hand movement range remains relatively the same for different positions of the actuator; however, the actuator causes the hand movement to move up and forward with longer pedal strokes for taller operators. For shorter operators, the hand movement lowers and moves towards the pedal when the control arm is lowered for shorter pedal strokes.

In an alternate embodiment, the roller cradle set supporting the foot support member is replaced by rollers rotatably attached directly to the crank. The control linkage includes a slidable coupling between the third control link and the rocker link guide. The second control link is attached to the rocker link guide. A collar is pivotally attached to the second control link so that the collar can slide along the length of the third control link. Alternately, the second control link can be attached to the third control link and the collar slidably connected to the rocker link guide. Control of the pedal stroke is as described for the preferred embodiment.

A pair of handles for arm exercise are attached to the go rocker link guides. In this case, the range of hand movement will increase with longer pedal movement for taller operators and decrease with shorter pedal strokes for shorter operators.

In another alternate embodiment, the rollers supporting the foot support member are replaced by a slider mechanism. The foot support member has a long slot which can slide on the crank pin. The rocker link guiding the foot support member is replaced by a roller rotatably attached to the foot support member and a track adjustably attached to the framework. The pedal is adjustably attached to the foot support member. The third control link is slidably connected to a collar that is directly attached to the foot support member by a pivot. Control linkage operation is similar to the preferred embodiment where the third control link movement is amplified to the foot support member for longer pedal strokes when the control arm is raised and decreased when the control arm is lowered for shorter pedal strokes. Adjustment of the track angle by an actuactor changes the orientation of the elliptical pedal path. The present invention allows independent adjustment of pedal stroke and ellipse orientation during operation of the exercise apparatus. Arm exercise is derived from the third control link as described in the preferred embodiment.

In each embodiment, the pedal is moved by the foot of the user where the pedal follows an elongate curve path while the foot support link moves back and forth relative to the crank. The length of the elongate curve path can be varied from about the diameter of crank movement to greater than twice the length of crank movement.

Load resistance is applied to the crank in each embodiment by a pulley which drives a belt to a smaller pulley attached to an alternator and flywheel supported by the framework. In each embodiment, the flywheel must overcome the torque provided by the alternator. Adjustment of the alternator electronics provides variable intensity exercise for the operator.

In summary, this invention provides the operator with stable foot pedal support having adjustable motions that simulate walking and jogging with very low joint impact while offering variable strides during operation from a compact machine with coordinated upper body exercise.

DETAILED DESCRIPTION OF THE EMBODIMENTS

Figure 1:
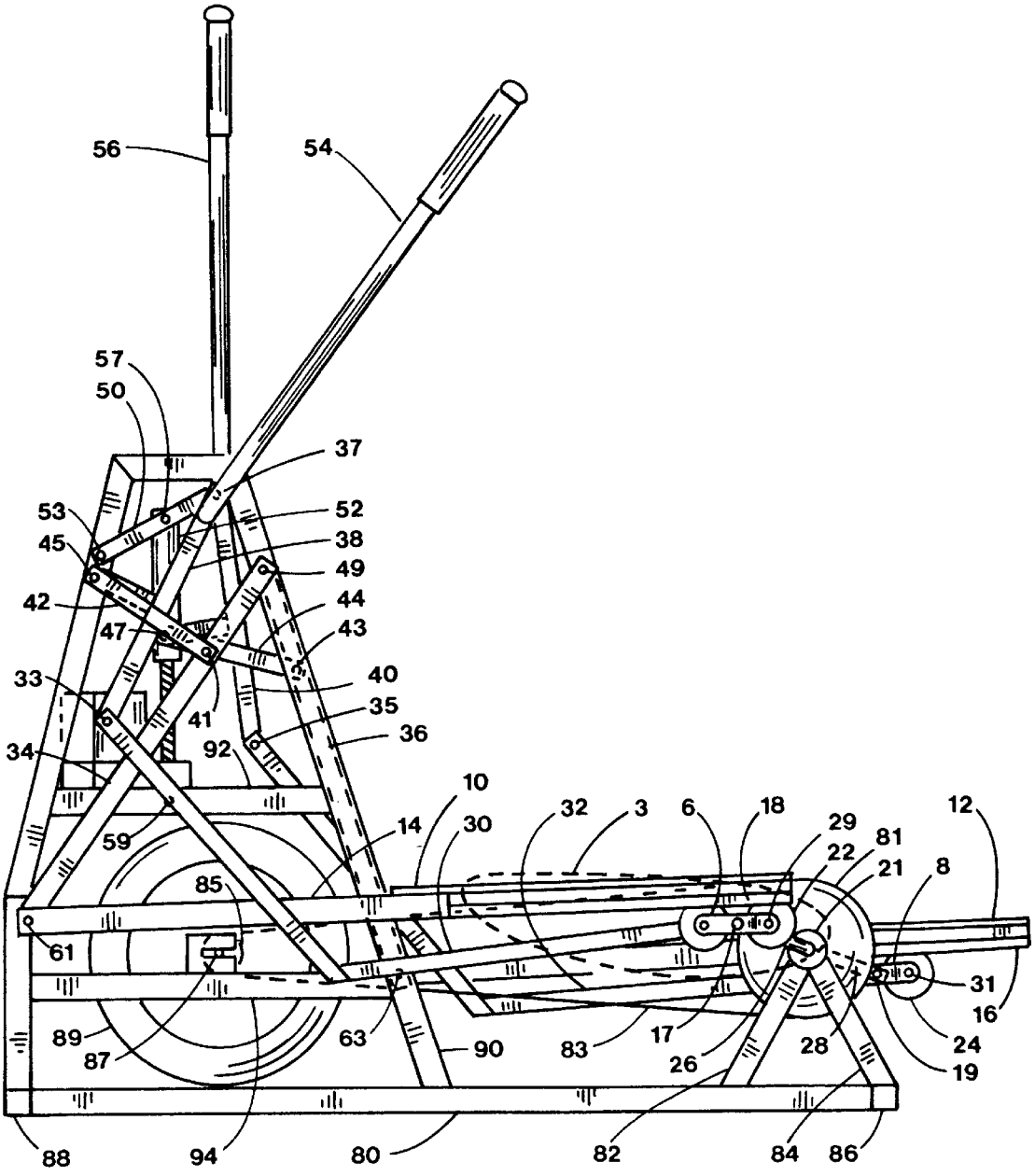
FIG. 1 is a right side elevation view of the preferred embodiment of an exercise machine constructed in accordance with the present invention.
Figure 2:
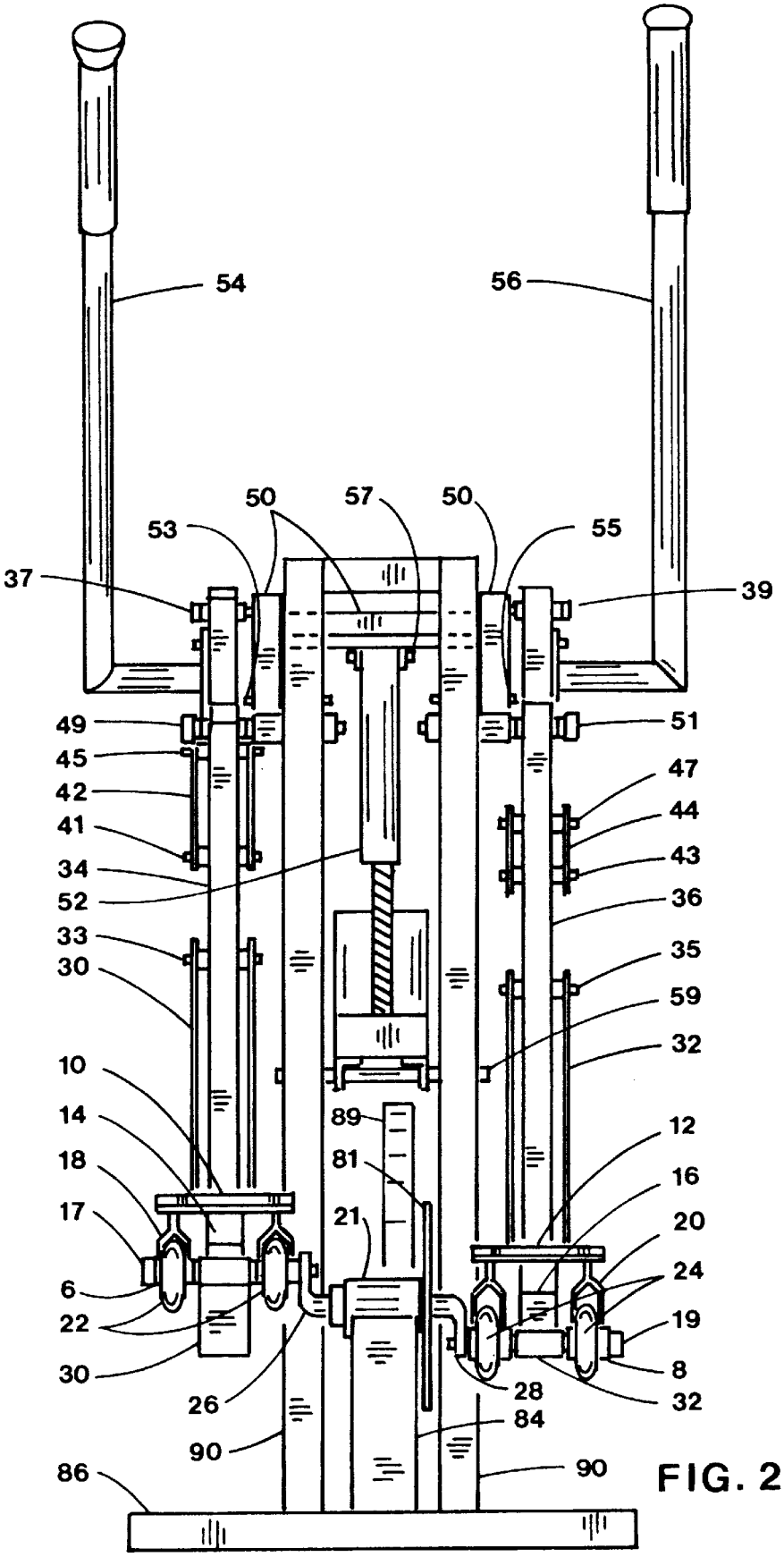
FIG. 2 is the front view of the preferred embodiment shown in FIG. 1.

Referring to the drawings in detail, pedals 10 and 12 are shown in FIGS. 1 and 2 in the most forward and rearward positions of the preferred embodiment. Pedals 10 and 12 are attached to foot support members 14,16 which are connected to rocker links 34,36 at pivots 61,63 at one end and supported by roller set 22,24 making rolling contact with foot support tracks 18,20 at the other end. Rocker links 34,36 are connected to frame member 90 at pivots 49,51.

Roller set 22,24 are rotatably connected to cradle arms 6,8 which are rotatably attached to crank pins 17,19. Crank pins 17,19 are attached to crank arms 26,28 which are joined inside bearing housing 21 attached to frame members 82,84 and protrude outwardly in generally opposing directions.

A control linkage determines the length of the pedal 10,12 stroke. The control linkage comprises: a first control link 30,32 rotatably attached to crank pins 17,19; a second control link 42,44 connected to rocker link guide 34,36 at pivots 41,43; a third control link 38,40 attached to first control link 30,32 at pivots 33,35 and to second control link 42,44 at pivots 45,47; a control arm 50 attached to frame upright member 90 at pivots 53,55 and to the third control link 38,40 at pivots 37,39.

An actuator 52 is attached to frame member 92 at pivot 59 and to control arm 50 at pivot 57. An electrical signal to actuator 52 will raise or lower control arm 50 which causes the third control link 38,40 to reposition relative to the rocker link guide 34,36. Raising the control arm 50 causes the rocker link guide 34,36 to reciprocate through a larger angle as the crank 26,28 rotates to guide foot support member 14,16 and pedal 10,12 through a longer elongate curve path 3 as shown in FIG. 1.

Handles 54,56 are attached to third control link 38,40 to provide arm exercise. As the control arm 50 is raised to provide a longer pedal 10,12 stroke for a taller operator, the handles 54,56 are also raised to accommodate the taller operator. Lowering the control arm 50 will lower the handles 54,56 and provide a shorter pedal 10,12 stroke.

Frame member 80 connects cross members 86,88 which contact the floor for support of the exercise machine. Frame members 82,84 connect to frame member 80 to support bearing housing 21. Frame upright member 90 is supported by frame member 80 with intermediate frame members 92,94 attached to frame members 90.

Load resistance is imposed upon cranks 26,28 by pulley 81 which drives flywheel/alternator 89 by belt 83 coupled to pulley 85. The flywheel/alternator 89 is supported by the frame 94 at shaft 87. Other forms of load resistance may also be used.

Application of body weight on the pedals 10,12 causes the pedals 10,12 to follow elliptical curve 3 shown in FIG. 1 and together with force applied at the arm levers 54,56 cause the linkage to rotate the flywheel 89 for a gain in momentum. This flywheel 89 momentum will carry the linkage system through any dead center positions of the crank 26,28. The pedals 10,12 and arm levers 54,56 can be operated to drive the flywheel 89 in either direction of rotation.

Figure 3:
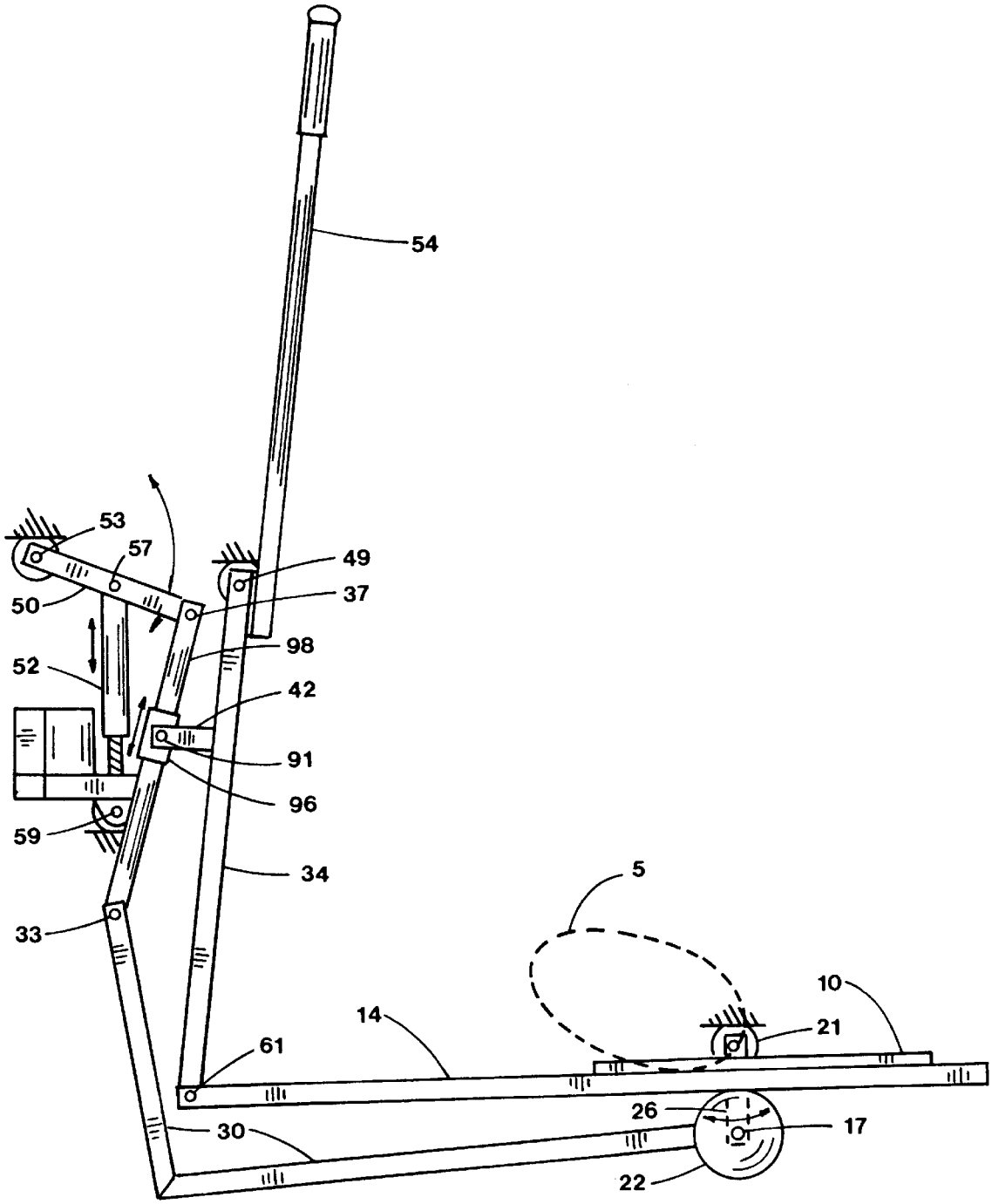
FIG. 3 is a right side schematic of an alternate embodiment showing only the left hand linkage members.

An alternate embodiment is shown in FIG. 3 with pedal 10 in the lowermost position. The foot support member 14 and rocker link 34 guide are the same as the preferred embodiment. Roller cradles 6,8 are not used and roller sets 22,24 are rotatably attached to crank pins 17,19. The control linkage contains the same control links as the preferred embodiment but the second control link 42 is now attached to rocker link 34 guide. Collar 96 is attached to the second control link 42 at pivot 91. Collar 96 is adapted to slide along the length of third control link 98. Raising or lowering the control arm 50 produces a longer or shorter pedal 10 stroke as in the preferred embodiment. Control arm 50 is shown in the lower position to generate a shorter elongate pedal curve 5 shown in FIG. 3.

Handle 54 is attached to rocker link 34 guide for arm exercise. The stroke of the handle 54 increases with an increase in pedal 10 stroke. The control linkage, handle 56, pedal 12, foot support member 16 and rocker link 36 for the right hand side are not shown for clarity. The framework 80,86,88,90 and load resistance is the same as the preferred embodiment and is not shown for clarity.

Figure 4:
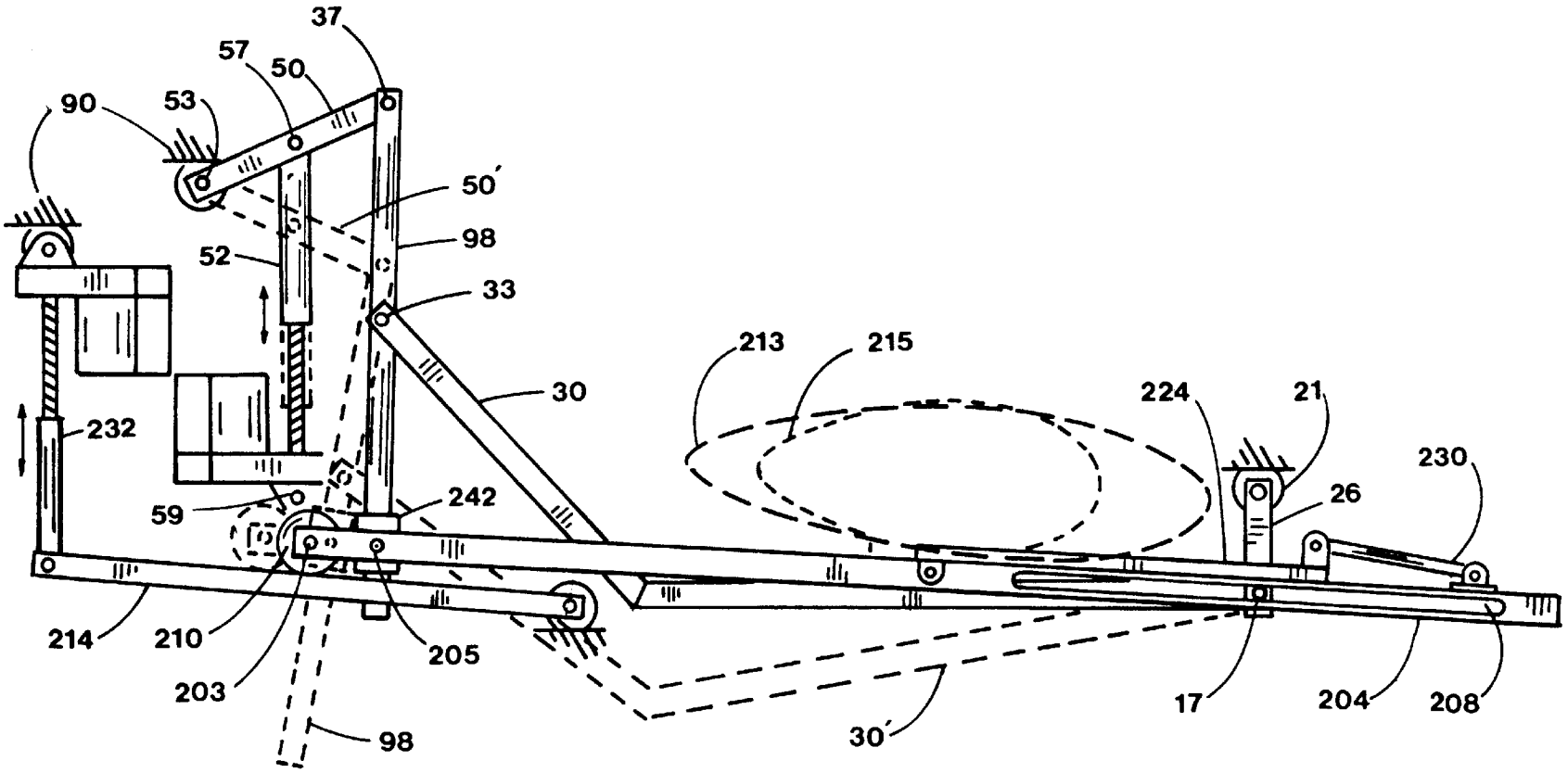
FIG. 4 is a right side schematic of an another alternate embodiment showing only the left hand linkage members.

In another alternate embodiment shown in FIG. 4 with pedal 224 in the lowermost position, foot support member 204 is slidably attached to crank pin 17 at slot 208. Rocker link 34 guide has been replaced with roller 210 attached to foot support member 204 at shaft 203. Track 214 is adjustably attached to frame member 90 with adjustment mechanism 232. Roller 210 is in rolling contact with track 214. The control linkage is similar to the preferred embodiment, however, the second control link 42 becomes collar 242 connected to foot support member 204 at pivot 205. The control linkage 50,98,30 is shown positioned to generate the longer stroke pedal path 213 as crank 26 rotates. Actuator 52 lowers the control linkage to position 50',98',30' to generate a shorter pedal path 215.

Arm exercise is derived from the third control link 98 as in the preferred embodiment (not shown). The right hand control linkage, pedal support mechanism, load resistance and framework are not shown for clarity. Pedal 224 is adjustably attached to foot support member 204 with adjustment mechanism 230.

In summary, the present invention has distinct advantages over prior art because the back and forth stride movement of the pedals can be changed during operation to accommodate the pedal stroke preference of the user. Arm exercise is also adjusted during operation when desired by the operator.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise machine comprising;

a framework configured to be supported on the floor;

a crank means rotatably connected to said framework, said crank means projecting outwardly therefrom on both sides thereof;

a pair of guide means, said guide means operably associated with said framework;

a foot support member for each foot, said foot support member operably associated with said crank means and said guide means to move with a generally back and forth orbital movement a roller means operably associated with said crank means to support a portion of said foot support member;

a control linkage means, said control linkage means having a plurality of control links operably associated with said crank means and said foot support member;

a pedal means operably associated with said foot support member to move along an elongate curve path having a predetermined curve length;

an actuator means, said actuator means operably associated with said framework and said control linkage means to cause a change in the relationship between said control links when desired by the operator;

said pedal means configured to move relative to said framework when the foot of the operator is rotating said crank means whereby said predetermined curve length can be changed during operation of said exercise machine.

2. The exercise machine according to claim 1 wherein said guide means comprises a rocker link, said rocker link pivotally connected to said framework and to said foot support member to guide one end of said foot support member along an arcuate path.

3. The exercise machine according to claim 1 wherein said guide means comprises a roller means rotatably connected proximate one end of said foot support member and a track means attached to said framework to guide one end of said foot support member along a guide path.

4. The exercise machine according to claim 1 wherein said control linkage means further comprises a control arm pivotally connected to said actuator means and to said framework, a first control link pivotally connected to said crank means, a second control link pivotally connected to said guide means, and a third control link pivotally connected to said control arm, said third control link pivotally connected to said first and said second control links whereby said actuator means impinges upon said control arm to move said third control link relative to said guide means.

5. The exercise machine according to claim 1 wherein said control linkage means further comprises a control arm pivotally connected to said actuator means and to said framework, a first control link pivotally connected to said crank means, a second control link attached to said guide means, and a third control link pivotally connected to said control arm, said third control link pivotally connected to said first control link and slidably connected to said second control link whereby said actuator means impinges upon said control arm to move said third control link relative to said guide means.

6. The exercise machine according to claim 3 wherein said control linkage means further comprises a control arm pivotally connected to said actuator means and to said framework, a first control link pivotally connected to said crank means, a second control link pivotally connected to said foot support means, and a third control link pivotally connected to said control arm, said third control link pivotally connected to said first control link and slidably connected to said second control link whereby said actuator means impinges upon said control arm to move said third control link relative to said foot support means.

7. The exercise machine according to claim 1 further comprising means for arm exercise operably associated with said control linkage means.

8. The exercise machine according to claim 4 further comprising means for arm exercise wherein said means for arm exercise is attached to said third control link whereby said means for arm exercise changes position relative to the operator when said actuator is operative.

9. The exercise machine according to claim 1 further comprising means for arm exercise wherein said means for arm exercise is operably associated with said guide means.

10. The exercise machine according to claim 1 further comprising a means for load resistance operably associated with said crank means.

11. The exercise machine according to claim 1 further comprising a means to adjust said pedal means relative to said foot support member.

12. The exercise machine according to claim 1 further comprising a means for adjusting the guide path of said guide means during operation of said exercise machine.

13. The exercise machine according to claim 1 wherein said foot support member is slidably connected to said crank means whereby said crank means provides generally up and down control for one end of said foot support member.

14. An exercise machine comprising;

a framework configured to be supported on the floor;

a crank means rotatably connected to said framework, said crank means projecting outwardly therefrom on both sides thereof;

a pair of guide means, said guide means operably associated with said framework;

a foot support member to support each foot, said foot support member operably associated with said crank means and said guide means to move with a generally back and forth orbital movement;

a control linkage means, said control linkage means having a a first control link pivotally connected to said crank means, a second control link pivotally connected to said guide means, a third control link pivotally connected to said first and to said second control links, and a control arm pivotally connected to said third control link and to said framework;

a means to change the position of said control linkage relative to said framework;

a pedal means operably associated with said foot support member to move along an elongate curve path having a predetermined pedal stroke length;

said pedal means configured to move relative to said framework when the foot of the user is rotating said crank means whereby said predetermined pedal stroke length can be changed during operation of said exercise machine with a change of position of said control linkage.

15. The exercise machine according to claim 14 wherein said guide means comprises a roller means rotatably connected proximate one end of said foot support member and a track means attached to said framework to guide one end of said foot support member along a guide path.

16. The exercise machine according to claim 14 wherein said guide means comprises a rocker link, said rocker link pivotally connected to said framework and to said foot support member to guide one end of said foot support member along an arcuate path.

17. The exercise machine according to claim 16 wherein said second control link is pivotally connected to said rocker link intermediate said rocker ends.

18. The exercise machine according to claim 14 further comprising a roller means operably associated with said crank means to support a portion of said foot support member.

19. The exercise machine according to claim 18 wherein said roller means further comprises a pair of rollers in rolling contact with said foot support member and rotatably attached to a cradle member, said cradle member being rotatably attached to said crank means.

20. The exercise machine according to claim 14 further comprising means for arm exercise operably associated with said control linkage means.

21. The exercise machine according to claim 14 further comprising means for arm exercise operably associated with said guide means.

22. An exercise machine comprising;

a framework configured to be supported on the floor;

a crank means rotatably connected to said framework, said crank means projecting outwardly therefrom on both sides thereof;

a pair of rocker links, said rocker link pivotally connected to said framework;

a foot support member to support each foot, said foot support member operably associated with said crank means and pivotally connected proximate one end to said rocker link;

a control linkage means, said control linkage means having a first said control link pivotally connected to said crank means, a second control link attached to said rocker means, a third control link pivotally connected to said first control link, said third control link slidably connected to said second control link, and a control arm pivotally connected to said third control link and to said framework;

an actuator means, said actuator means operably associated with said framework and said control arm;

a pedal means operably associated with said foot support member to move along an elongate curve path having a predetermined pedal stroke length;

said pedal means configured to move relative to said framework when the foot of the user is rotating said crank means whereby said predetermined pedal stroke length can be changed during operation by said actuator means.

23. The exercise machine according to claim 22 further comprising means for arm exercise operably associated with said control linkage means.

24. The exercise machine according to claim 22 further comprising means for arm exercise wherein said means for arm exercise is operably associated with said rocker link.

25. An exercise machine comprising;

a framework configured to be supported on the floor;

a crank means rotatably connected to said framework, said crank means projecting outwardly therefrom on both sides thereof;

a track means operably associated with said framework;

a pair of roller means, said roller means in rolling contact with said track means;

a foot support member to support each foot, said foot support member operably associated with said crank means and rotatably connected to said roller means to move with a generally back and forth orbital movement;

a control linkage means, said control linkage means having a a first control link pivotally connected to said crank means, a second control link pivotally connected to said foot support means, a third control link pivotally connected to said first control link and slidably associated with said second control link, and a control arm pivotally connected to said third control link and to said framework;

a means to change the position of said control linkage relative to said framework;

a pedal means operably associated with said foot support member to move along an elongate curve path having a predetermined pedal stroke length;

said pedal means configured to move relative to said framework when the foot of the user is rotating said crank means whereby said predetermined pedal stroke length can be changed during operation of said exercise machine with a change of position of said control linkage.

26. The exercise machine according to claim 25 further comprising means for arm exercise operably associated with said control linkage means.

27. The exercise machine according to claim 25 further comprising means for adjustment of said track means relative to said framework during operation of said exercise machine.

* * * * *